United States Patent [19]

Blain

[11] Patent Number: 4,684,882

[45] Date of Patent: Aug. 4, 1987

[54] ELECTRICAL TRANSFORMER HAVING A SOLID CORE SURROUNDING WINDING IN A LOOP CONFIGURATION

[76] Inventor: Aurele J. Blain, 23 Allanbrooke Drive, Islington, Ontario, Canada, M9A 3N7

[21] Appl. No.: 740,685

[22] Filed: Jun. 3, 1985

Related U.S. Application Data

[63] Continuation-in-part of Ser. No. 456,329, Feb. 18, 1983.

[51] Int. Cl.[4] ..... H01F 15/18

[52] U.S. Cl. ..... 323/356; 323/362; 336/83; 336/98; 336/175; 336/221

[58] Field of Search ..... 323/308, 309, 355, 362, 323/356; 336/175, 176, 195, 221, 178, 98, 83

[56] References Cited

U.S. PATENT DOCUMENTS

| | | | |
|---|---|---|---|
| 2,948,871 | 8/1960 | Craige | 336/83 |
| 2,949,591 | 8/1960 | Craige | 336/83 |
| 3,358,256 | 12/1967 | Naito et al. | 336/83 |
| 3,532,964 | 10/1970 | Marks | 323/356 |
| 3,883,835 | 5/1975 | Pagon et al. | 336/90 |
| 4,088,942 | 5/1978 | Miko | 336/165 |
| 4,210,859 | 7/1980 | Meretsky et al. | 336/188 |

FOREIGN PATENT DOCUMENTS

| | | | |
|---|---|---|---|
| 15349 | 11/1933 | Australia | 336/83 |

OTHER PUBLICATIONS

Standard Handbook for Electrical Engineers by Fink and Carroll (10th Edition) published in 1968 by McCraw-Hill, Inc., pp. 16-185 to 16-186.

Standard Handbook for Electrical Engineers by Fink and Carroll (11th Edition) published in 1978 by McCraw-Hill Inc., pp. 18-50 to 18-51 and pp. 10-109 to 10-113.

*Primary Examiner*—William H. Beha, Jr.

*Attorney, Agent, or Firm*—Rogers, Bereskin & Parr

[57] ABSTRACT

An electrical transformer having a rectangular core of solid magnetic material, forming a circular or rectangular-section shell in which primary and secondary windings are located. The corners of the core may be open to lighten the transformer and increase heat dissipation. A capacitor may be connected across the secondary winding to increase the efficiency of the transformer.

7 Claims, 10 Drawing Figures

ELECTRICAL TRANSFORMER HAVING A SOLID CORE SURROUNDING WINDING IN A LOOP CONFIGURATION

This is a continuation-in-part of application Ser. No. 456,329 filed Feb. 18, 1983.

FIELD OF THE INVENTION

This invention relates generally to electrical transformers.

BACKGROUND OF THE INVENTION

Various configurations of electrical transformer are known. The two main types in common use are the core type transformer and the shell type transformer. In the core type transformer, a primary winding and a secondary winding are wound around a magnetic core in the form of a ring. In a shell type transformer, the primary winding and the secondary winding form a common ring which is surrounded by rings of magnetic material distributed about the common ring.

In any transformer it is important to have a high flux within the closed loop of the primary and secondary windings. This may be achieved by increasing the number of primary or secondary windings or both, or by increasing the length of the magnetic circuit. Thus, increasing the cross-sectional area of the core will increase the flux, since the flux is directly proportional to the cross-sectional area of the core. This will increase the performance of the transformer; however, it will also increase the weight of the transformer. Increasing the number of turns in the windings or increasing the area of the core also hinders heat dissipation.

It is generally known that increasing the cross-sectional area of the core also increases eddy currents. For this reason, laminated cores are used in most applications. However, high frequency perturbations in the laminated core cause significant rattling and noise, as is well known, and such laminated cores are difficult and expensive to construct.

SUMMARY OF THE INVENTION

The invention provides an electrical transformer comprising a core having the general shape of a rectangular loop defined by four limbs disposed mutually at right angles, and primary and secondary windings extending around the loop. Each limb of the core comprises a closed elongate channel of solid magnetic material through which the windings extend. The channels are magnetically connected but include an electrically insulating break for preventing eddy current flow around the loop.

By constructing a transformer with a solid core in rectangular shape I have found that eddy current problems are minimized and that a light and efficient transformer may be made inexpensively.

I have also found that placing a capacitor across the secondary winding increases the efficiency and performance of the transformer.

BRIEF DESCRIPTION OF THE DRAWINGS

Reference will now be made to the accompanying drawings which illustrate preferred embodiments of the invention by way of example, and in which.

DESCRIPTION OF THE PREFERRED EMBODIMENTS

The transformers described below are designed for use with alternating currents of frequency less than 500 Hz, and the term "low frequency" is used to describe such frequencies.

Figure 1:
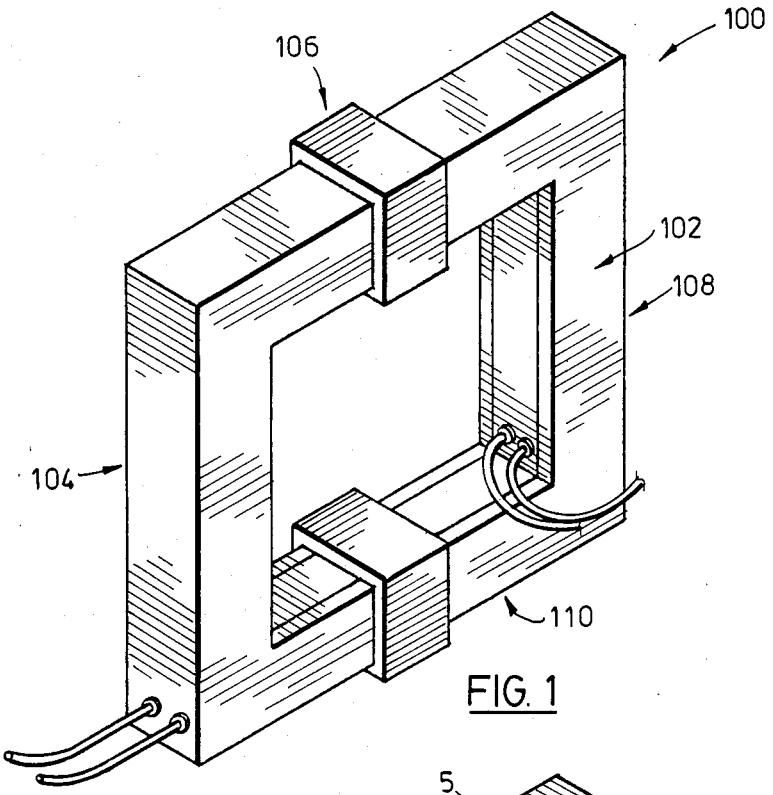
FIG. 1 is an isometric view of an electrical transformer according to a first embodiment of the invention.

Referring first to FIG. 1, an electrical transformer is generally indicated by reference numeral 100 and includes a core 102 having the general shape of a rectangular loop defined by four limbs 104, 106, 108 and 110 disposed mutually at right angles. Primary and secondary windings best seen in FIG. 2 (see later) extend around the loop. As will be described in more detail later, each limb of the core comprises a closed elongate channel of solid magnetic material through which the windings extend. The channels are magnetically connected but include an electrically insulating break for preventing eddy current flow around the loop.

Figure 2:
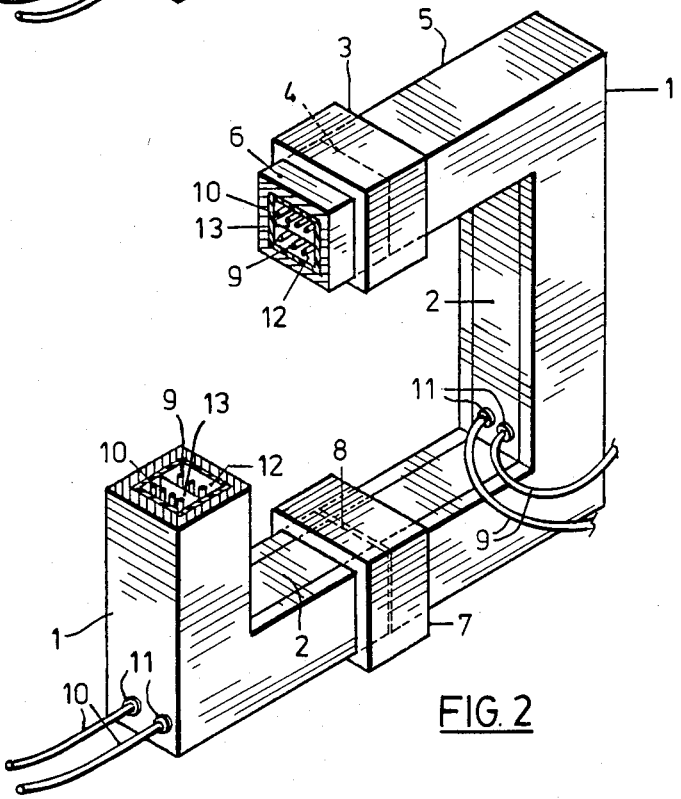
FIG. 2 is a cut-away view of the electrical transformer of FIG. 1.

Referring now to FIG. 2 the core 100 is formed as two generally C-shaped casing halves 1 fitted together in opposing relationship. Each half has a flat inner member 2 and a channel-section outer member, both formed of solid magnetic material; the members are combined as shown to form a closed shell. To assemble the transformer, primary and secondary windings 9 and 10 respectively are placed over the inner members 2 and then the outer members 5 are slipped over the windings 9 and 10 so that the casing will completely surround the windings.

The hidden line 4 represents the joint between the two channel members 5 at which a connected magnetic circuit is formed. A collar 3 is cemented or bolted over the joint between the two channel members 5 to make the casing rigid.

Insulating material 8 is placed in the other gap between the channel members 5 so that electric currents (known as eddy currents) cannot flow around the core in the same direction as the current flows in the windings. A collar 7 also made of insulating material is cemented or bolted over the gap containing the insulating material 8.

Insulating material 11 insulates the windings 9 and 10 from the casing.

Having the magnetic circuit elements on the outside of the transformer facilitates the dissipation of heat from the transformer.

Figure 3:
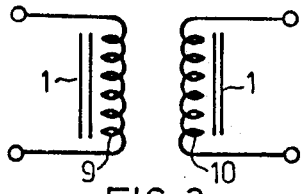
FIG. 3 is a representation of the electrical circuit of the transformer of FIG. 1.

FIG. 3 is a schematic representation of the circuit of FIG. 1.

In any transformer, the impedance of the primary winding and the voltage induced in the secondary will vary as the square of the number of turns in the winding, assuming the flux path of the core or shell as the case may be does not change. For example, if the primary and secondary turns are doubled and the flux path of the core of shell remains the same, the impedance of the primary, and consequently the voltage output of secondary winding, will be increased four times. In the preceding example when the primary winding is doubled, and assuming the same current flows in the winding, the flux produced will be doubled and two times more flux cutting two times more wire will induce four times more voltage in the winding. However, due to space restrictions an increase in the number of turns necessarily increases the flux path of the core. Thus the impedance of the windings will not vary exactly as the square of the increase in number of turns; it will be less by an amount proportional to the increase in flux path of the core.

The area of a square or rectangle varies proportionally with the square of its perimeter, and similarly the area of a circle varies proportionally with the square of its circumference. The perimeter of a rectangle will be greater than the perimeter of a square which is the same area, and the perimeter of a square will be greater than the circumference of a circle which has the same area.

In a conventional shell type of transformer core the winding area is rectangular; by comparing the mean flux path to the mean flux path on a square as in the present invention it is found that if the winding area of the channel is one half the winding area of the conventional transformer, the mean cross-section perimeter of the channel will be almost one half the mean perimeter of the conventional transformer winding area. Furthermore, if the channel is constructed in the form of tube the mean perimeter will be less than the square channel by about 10%.

In the present invention the windings are completely surrounded by a casing, and by extending the casing the windings will enclose a greater flux path. Thus increasing the length of the windings and the number of turns, increases the impedance of the primary windings and increases the induced voltage thus making it possible to decrease the thickness of the casing and still maintain the efficienty of the transformer.

In the present invention, however, it is not practical to increase the length of the casing to an extent such that the number of conductors in the casing becomes too small. A rule to follow is to have as many conductors as possible without increasing the resistance of the windings too much, while maintaining the cross-section perimeter of the casing as small as possible, and while maintaining the length of the casing so that the windings will enclose a fair amount of flux path.

The cross-sectional area of the core 100 is found by multiplying the thickness of the casing wall by the mean length of the inner-section 2. The mean length is found by adding four times the thickness of the casing to the inner surface length of the inner-section 2. That is, $A=t\times l$, where t equals thickness of casing wall and l equals length of mean inner-section 2 and A is the cross-sectional area of the casing.

Referring to FIG. 2, a paper insulator 13 insulates the primary winding 9 from the secondary winding 10; if necessary, additional insulation (not shown) can be used between each layer of the windings. An insulator 12 insulates the two windings 9 and 10 from the casing 1. The windings are rigidly supported with respect to the casing so that they will not move under influence of the magnetic field, as is well known in the art.

When alternating voltage is applied to the primary winding 9 current will flow through the primary. However, as the current increases a magnetic field will rise around the conductors and this field will cut the adjacent conductors of the primary and induce a voltage in them which will be in reverse polarity to the applied voltage. It is important that the casing be made large enough so that sufficient magnetic field is produced to oppose the applied voltage almost completely. This will make the transformer efficient. The magnetic field will also cut the conductors of the secondary 10 and induce a voltage in them. If there is a load across the secondary winding, current will flow in the secondary and create a magnetic field that will be in direct opposition to, that is, one half cycle out-of-phase with, the field produced by the primary 9. The magnetic field about the secondary will oppose the field of the primary and it will cancel some of it. The amount depends on the current flowing in the secondary 10.

Since the field of the secondary cancels some of the primary field, the impedance of the primary will be decreased and more current will flow in the primary 9, thereby increasing the magnetic field about the primary and inducing a larger current in the secondary.

As the magnetic field due to the primary 9 increases, it penetrates the casing 1 and induces a small current in the casing. The direction of the current is the same as the current or voltage induced in the secondary 10. If this current is permitted to flow, the magnetic field thereby produced will oppose the magnetic field of the primary causing more current to flow in the primary. As a result the efficiency of the transformer will be decreased. This effect will be more noticeable when no current is flowing in the secondary because when current flows in the secondary the field of the secondary will tend to cancel or induce the voltage in the casing 1 which will oppose the voltage induced in the casing by the primary. To prevent the current from flowing around the casing, the casing is separated by insulator 8 in FIG. 2 so that current cannot flow. There is still a possibility that a small current could flow in the casing, for example, when the field arises around the primary 9. For example, a current could flow in the inner wall of the casing and return by the outer wall. While the current flowing in the inner wall would produce a field that would tend to oppose the field of the primary, the field produced by the current flowing back in the outer wall would produce a field that would add to the field of the primary. Thus, the two fields in the core would be largely neutralized and the transformer efficiency will not be decreased.

Figure 7:
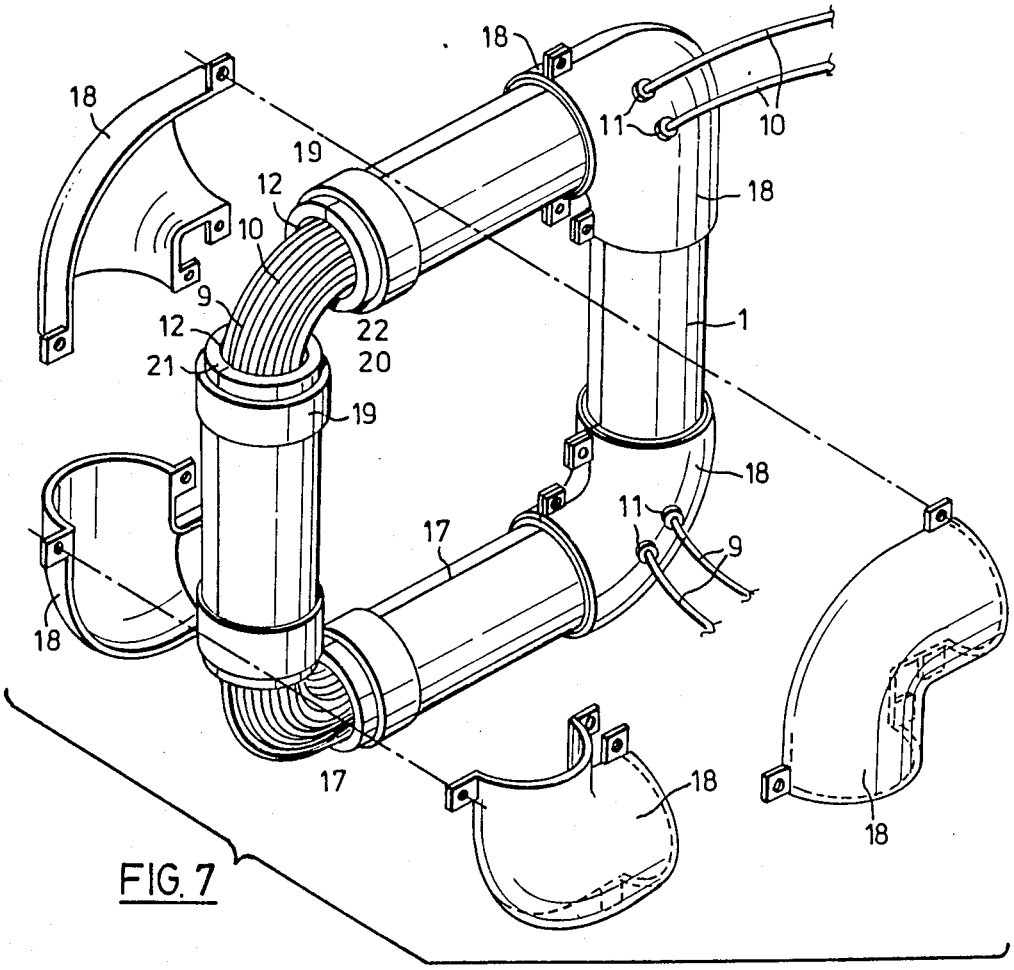
FIG. 7 is a perspective view of an electrical transformer with a generally tubular core, according to a further embodiment of the invention; and, FIGS. 8, 8*a*, and 9 illustrate a transformer which is generally similar to the transformer of FIG. 7 but having a square-section core.

Referring next to FIG. 7, that view shows a transformer which is essentially similar to and functions in the same manner as the transformer in FIG. 2; however, in FIG. 7, the core of the transformer is of tubular form. There is an advantage to buidling the core in this form. In a tube the cross-section perimeter is less than the cross-section perimeter of a square having the same winding area. Thus a transformer with a tubular core will have a larger flux path for the same weight of material.

In the transformer of FIG. 7 each limb of the core comprises two half sections of tubular magnetic material clamped together. For example, the limb which appears at the left in FIG. 7 comprises two sections 20, 21 held together by clamps 18 at the corners of the core.

The line 17 represents a joint between the two sections 20 and 21. The corners of the core are omitted because their contribution to the mean flux path is insignificant compared with the added cost and complexity of constructing the corners. By omitting the corners the transformer can be made with less magnetic material resulting in a transformer considerably lighter, and with greater heat dissipating capacity. A gap 22 is maintained at each corner of the core to prevent the flow of induced eddy currents around the core. The clamps 18 can be made of metal (e.g. aluminum) of sufficient thickness to secure the two sections 20 and 21 securely. Insulators 19 assure that the clamps 18 will not short-circuit the core and the gaps 22 will be maintained.

Figure 8:
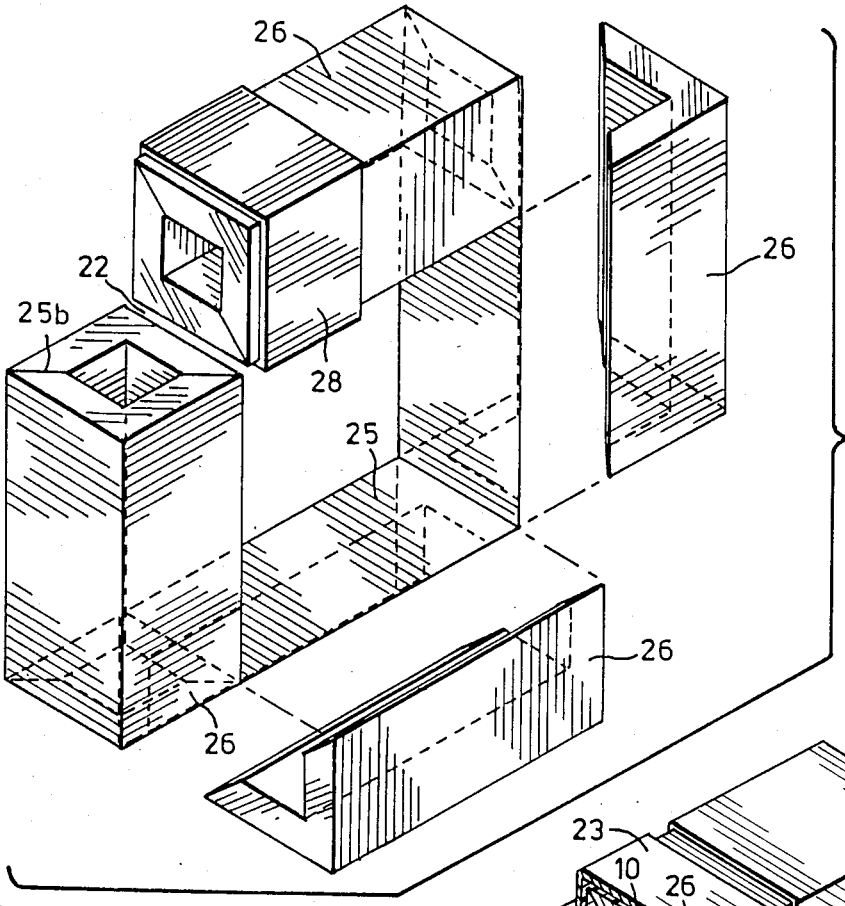
Figure 8A:
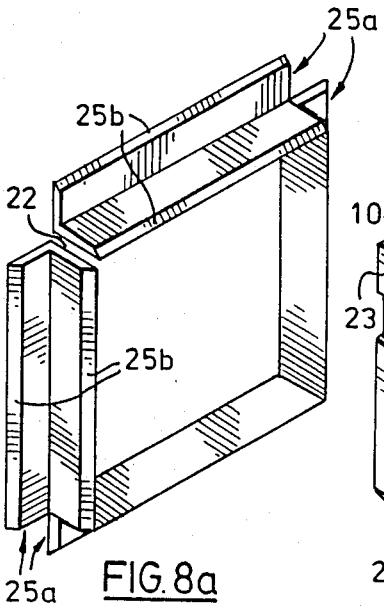
Figure 9:
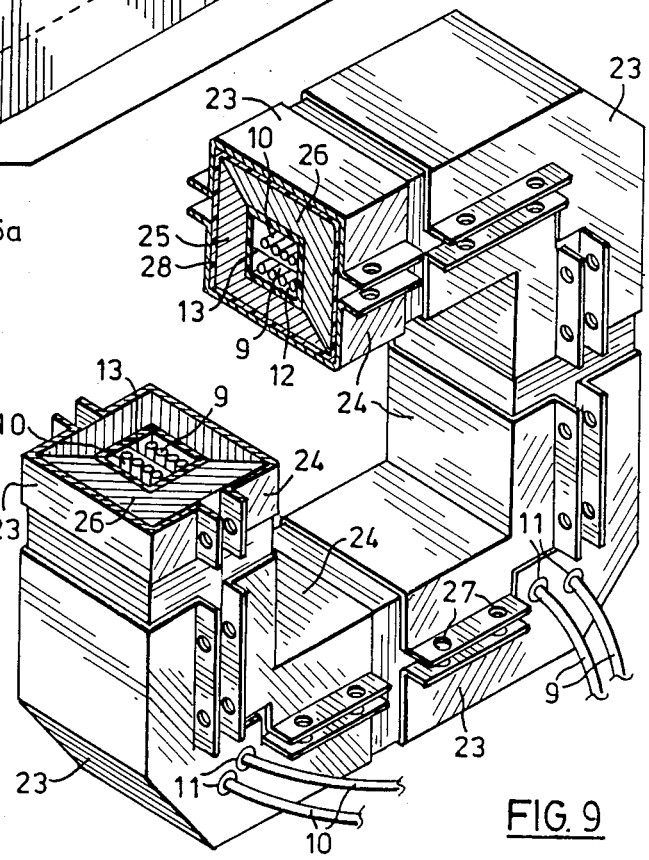

FIGS. 8, 8*a* and 9 illustrate a transformer in accordance with a further embodiment of the invention, which is generally similar to the transformer of FIG. 7 but in which the core defines a closed channel of square shape in cross-section. This design of transformer may have some advantages in that the windings may be easier to form. However, it is believed that the reluctance path of the core of this transformer will be higher (possibly by about 10%) than the transformer of FIG. 7.

As shown in FIGS. 8 and 8*a*, the transformer core is formed from a length of angle iron of suitable composition which is partially cut and bent to form a rectangular loop 25 as shown in FIG. 8*a*, having a gap 22. The loop includes four sections 25*a* of angle iron, the long outer edges of which are tapered as indicated at 25*b* in FIG. 8. Four sections 26 of angle iron having correspondingly tapered edges are then fitted to the four sections of loop 25 and are secured thereto by clamps 23 and 25 as shown in FIG. 9. The clamps 23 and 24 are secured together by rivets or bolts (not shown) extending through holes 27 in the clamps.

The clamps 23 and 24 of FIG. 9 can be made of magnetic material. This will decrease any magnetic leakage at the junctions between the core sections 26 and 25*a*.

The gap 22 in both FIGS. 7 and 8 is to provide an open circuit to the flow of eddy currents in the core. Although the gap is shown as quite wide in the drawings, only a very small gap is required in practice. The ends of the core at the position of the gap could be tapered. This would decrease the possibility of any magnetic leakage at this location.

FIG. 9 shows the assembled transformer partly cut away to show internal structure.

The core shown in FIGS. 7, 8 and 9 is not necessarily in the form of a square loop but could be of other rectangular shape or even triangular.

In the embodiment of FIGS. 8 and 9, an insulator 28 is used on only one leg of the core as compared with FIG. 7. In any event, due to the fact that very low voltages are induced in the core, the insulator 28 of FIGS. 8 and 9 and the insulator 19 of FIG. 7 need not have high insulating properties.

Figure 4:
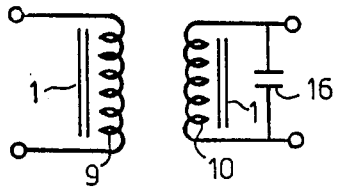
FIG. 4 is a representation of a modification of the electrical circuit of FIG. 1.

In the transformer of FIGS. 7, 8 and 9, the cores and bracket assemblies form a transformer in which the windings are completely surrounded. This equalizes heat distribution through the core and windings for promoting even expansion and contraction of the core and the windings. It is believed that complete enclosure of the windings may also tend to inhibit deterioration of the windings between hot and cold junctions which could occur where the windings are only partially enclosed.

Where it is desired to have a lightweight transformer, where portability is desired or where a very high primary impedance is desired, the arrangement of FIG. 4 may be employed. In that embodiment, a capacitor 16 is connected across the secondary winding 10 of the transformer. The capacitance of capacitor 16 is chosen so that it will form an oscillating circuit with the secondary winding 10. The oscillations will cause a voltage to be induced in the primary 9 which will oppose the applied voltage.

For every quarter cycle of the alternating current applied to the primary, there is a change in the direction of the magnetic field. Thus when the current in the primary is rising the field will also be rising, but a quarter cycle later when the current has reached maximum and is decreasing, the magnetic field will be decreasing. Another quarter cycle later, after the current has reached zero, it rises in the opposite direction and the magnetic field will again be increasing in the opposite direction.

When the current in the primary 9 is rising the field of the primary will induce a current in the secondary 10 that will be 180 degrees or one half cycle out of phase with the primary current. The field of the secondary will then induce a voltage in the primary that will add to the applied voltage. Now, if the phase of the current in the secondary 10 is caused to lead or lag by 90 degrees or one quarter cycle, the field of the secondary will induce a voltage in the primary that will oppose the applied voltage. This occurs because for every quarter cycle there is a reversal of magnetic field.

In the circuit of FIG. 4, the current that sustains the oscillation is induced in the secondary by the primary magnetic field and the oscillating current in the secondary will lead this current by about one quarter cycle or 90 degrees. Also, the oscillating current in the secondary will produce a flux in the casing that will maintain the secondary output voltage. The oscillations in the secondary circuit are damped oscillations. That is, if a circuit oscillated fully the voltage across the secondary and capacitor would be very high. This is impossible because as the voltage in the primary rises higher than the output voltage of the secondary, the opposing voltage induced in the primary would also be higher than the applied voltage, and no current would flow.

Figure 5:
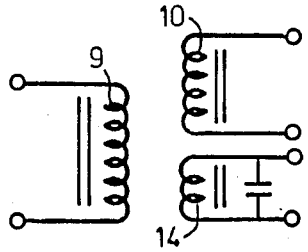
FIG. 5 is a representation of a further modification of the electrical circuit of FIG. 1.

In FIG. 5, the capacitor 16 is connected across a separate winding and a similar result is obtained to the circuit shown in FIG. 4.

With an oscillating circuit it is possible to reduce the weight of the core and still maintain a high primary impedance, or if the same size core is maintained, to use the oscillating circuit to increase the primary impedance.

To decrease the weight of the core its walls can be made thinner so that the transformer will still function without driving the core to saturation. This will cause the primary current to be increased.

When a capacitor is connected across the secondary winding of the transformer, the oscillating flux will cause the primary current to decrease approximately to its original value, and the transformer will function much the same as before the walls of the channel were made thinner.

I have found that by adding a capacitor to the secondary output to the conventional electric transformer so that the capacitor causes an oscillation in the secondary winding, the primary impedance of that transformer will be greatly increased.

Thus, adding a capacitor across the secondary winding of a transformer increases the efficiency of the transformer under no load and for small load conditions.

Figure 6:
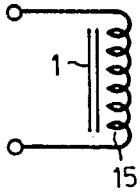
FIG. 6 is a representation of the electrical circuit of a reactance coil; the coil consists of the embodiment of FIG. 1 with only one winding in the channel.

The embodiment of FIG. 1 could be used as a reactance coil. The reactance of the coil will depend upon the size of the casing 1 and the length of conductors in the casing. If an air gap is required, the width of the inner member 2 could be decreased so that an air gap would exist between it and the walls of the associated channel member. The reactance coil is schematically shown in FIG. 6.

It is believed that a transformer of the form provided by the present invention will offer significant advantages as compared with the prior art. Some of those advantages have been indicated previously. It is believed that one advantage will be that eddy current flow will be less than in a conventional transformer in which the windings are wound around a core such as the shell-type of laminated core. In such conventional transformers, a large magnetic flux will penetrate deeply into the core and some eddy current will be induced in the core. The resistance of the core to this current will be at a minimum.

In the transformer of the present invention, the core is in the form of a closed channel. The walls of the channel can be made thinner so that the flux will not penetrate the core to the same extent as in a conventional transformer and the channel will provide a much greater resistance to eddy currents than a conventional transformer.

It will, of course, be understood that the preceding description relates to particular preferred embodiments of the invention and that many modifications are possible within the broad scope of the invention. For example, the particular materials referred to previously may, of course, vary. Particularly, the core may be made of any suitable magnetic material.

Transformers of the form provided by the present invention can of course be coupled together by connecting the respective primary and secondary windings in series, to provide a larger capacity.

I claim:

1. A low-frequency electrical transformer comprising a core having the general shape of an angular loop defined by at least three limbs, and primary and secondary windings extending around the loop, wherein each limb of the core comprises a closed elongate channel of solid magnetic material through which the windings extend, said channels being magnetically connected but including an electrically insulating break for preventing eddy current flow around the loop, wherein the core comprises: an iron angle section member formed into the configuration of said angular loop, so that one side of the angle section member forms the bases of the said channels and the other side of the member forms one side of each said channel; individual angle section members disposed one along each limb of the core and co-operating with the first mentioned angle member to form said channels; and bracket means clamping said angle section members together.

2. A transformer as claimed in claim 1, wherein said channels are of square shape in cross-section.

3. A transformer as claimed in claim 1, wherein said primary and secondary windings are completely enclosed for equalizing heat distribution between the windings and core.

4. A transformer as claimed in claim 1, wherein said channels members are permanently secured together at corners of the loop by brackets.

5. A transformer as claimed in claim 4, wherein said brackets completely enclose the windings between the channels for equalizing heat distribution between the channels and the windings.

6. A transformer as claimed in claim 1, further comprising a capacitor connected across the secondary winding of the transformer.

7. An electrical transformer comprising a core having the general shape of a rectangular loop defined by four limbs disposed mutually at right angles, and primary and secondary windings extending around the loop, wherein each limb of the core comprises a closed elongate channel of solid magnetic material through which the windings extend, said channels being magnetically connected but including an electrically insulating break for preventing eddy current flow around the loop, wherein the core comprises: an iron angle section member formed into a square configuration so that one side of the angle section member forms the bases of the said channels and the other side of the member forms one side of each said channel; four individual angle section members disposed one along each limb of the core and co-operating with the first mentioned angle member to form said channels; and bracket means clamping said angle section members together.

* * * * *